US005994824A

United States Patent [19]

Thomas et al.

[11] Patent Number: 5,994,824

[45] Date of Patent: Nov. 30, 1999

[54] LIGHT WEIGHT/SMALL IMAGE INTENSIFIER TUBE

[75] Inventors: Nils I. Thomas, Roanoke; James W. Harris, Moneta; Walter E. Blouch; Warren D. Vrescak, both of Roanoke; George A. Hambro, Blue Ridge; Mark L. Oyler, Roanoke; Stanley J. Clower, Roanoke; Nelson C. Devoe, Roanoke; Robert A. Gallagher, Roanoke, all of Va.

[73] Assignee: ITT Manufacturing Enterprises, Wilmington, Del.

[21] Appl. No.: 08/899,725

[22] Filed: Jul. 24, 1997

[51] Int. Cl.[6] ..... H01J 43/00

[52] U.S. Cl. ..... 313/105 CM; 313/103 CM; 313/544

[58] Field of Search ..... 313/523, 524, 313/105 CM, 103 CM, 544, 525, 471 R, 528; 250/214 VT

[56] References Cited

U.S. PATENT DOCUMENTS

| | | | |
|---|---|---|---|
| 5,369,267 | 11/1994 | Johnson et al. | 250/214 VT |
| 5,510,673 | 4/1996 | Wodecki et al. | 313/524 |
| 5,514,928 | 5/1996 | Niewold | 313/105 CM |

*Primary Examiner*—Nimeshkumar D. Patel
*Assistant Examiner*—Michael J. Smith
*Attorney, Agent, or Firm*—Arthur L. Plevy

[57] ABSTRACT

An improved image intensifier tube having electrically operative components that include a photocathode having a photoemissive layer, a microchannel plate having a conductive input surface and a conductive output surface, and a vacuum housing for retaining the photocathode, the microchannel plate and a fiber optic inverter in a predetermined arrangement within an evacuated environment, the fiber optic inverter having a phosphor screen for receiving the electrons emitted by the cathode and converting the electrons into a visual image, the improvement therewith comprising a ring assembly disposed in the housing comprising first and second rings, the first ring being a metallized snap ring conductively contacting the input surface of the microchannel plate for providing electrical contact to and retaining the plate within the housing, the second ring being a metallized ceramic ring having a first chamfered metallized surface in electrical contact with the metallized snap ring and a second metallized surface operable to provide an electrical contact external to the housing; and the fiber optic inverter having a unitarily formed and circumferentially extending flange portion extending toward the housing, wherein a sealing material sealingly engages an inner surface of an output flange with the inverter flange portion to form an air impervious vacuum seal, the output flange supported by the inverter flange portion.

22 Claims, 9 Drawing Sheets

LIGHT WEIGHT/SMALL IMAGE INTENSIFIER TUBE

FIELD OF THE INVENTION

The invention relates to improvements in image intensifier tubes of the type used in night vision equipment and, more particularly, to an improved vacuum housing structure for proximity focused image intensifiers having a metallized ceramic and conductive snap ring for retaining a microchannel plate and a direct fiber optic-to-housing vacuum seal for reduced device size and weight.

BACKGROUND OF THE INVENTION

Image intensifier devices multiply the amount of incident light they receive and provide an increase in light output, which can be supplied either to a camera or directly to the eyes of a viewer. Image intensifiers are constructed for a variety of applications and hence vary in both shape and size, with proximity focused image intensifiers comprising a particular type of image intensifier having the smallest size and weight of all categories of image intensifiers. These devices are particularly useful for providing images from dark regions and have both industrial and military applications. For example, image intensifiers are used in night vision goggles for enhancing the night vision of aviators and other military personnel performing covert operations. They are employed in security cameras and in medical instruments to help alleviate conditions such as retinitis pigmentosis (night blindness). Such an image intensifier device is exemplified by U.S. Pat. No. 5,084,780 entitled TELESCOPIC SIGHT FOR DAY/NIGHT VIEWING by Earl N. Phillips issued on Jan. 28, 1992.

Image intensifiers include active elements, support elements and supply elements. The active elements include the photo-cathode (commonly called simply "cathode"), microchannel plate (MCP), phosphor screen (screen), and getter. The cathode detects a light image and changes the light image into an electron image. The MCP amplifies the electron image and the screen changes the electron image back to an light image. The getter absorbs gas which is generated during operation of the tube.

The support elements comprise the mechanical elements which physically support the active elements of the tube. In a standard proximity focused tube these support elements are the vacuum envelope (known as the body), input faceplate (sometimes also called "cathode"), and the output faceplate or fiber-optic (also called "screen").

The supply elements in the tube include the chrome contact that is deposited on the faceplate to the cathode, the screen aluminum contact which is deposited on the fiber-optic or output faceplate, and the metalizing on the MCP glass. In addition the metal parts in the body assembly also provide electrical contact.

Finally there are packaging elements which perform other functions. The fiber-optics direct the image generated by the screen to a convenient position so that the system optics can properly direct the image to the ocular plane.

As is known, three major components of modem image intensifier tubes are the photocathode, phosphor screen (anode), and MCP disposed between the photocathode and anode. These three components are positioned within the evacuated housing or vacuum envelope, thereby permitting electrons to flow from the photocathode through the MCP and to the anode. In order for the image intensifier tube to operate, the photocathode and anode are normally coupled to an electric source whereby the anode is maintained at a higher positive potential than the photocathode. Similarly, the MCP is biased and operates to increase the density of the electron emission set forth by the photocathode. Furthermore, since the photocathode, MCP and anode are all held at different electrical potentials, all three components are electrically isolated from one another when retained within the vacuum housing.

Three major conceptions regarding the structure and function of image intensifier tubes exist in the prior art. The first prior art intensifier tube is an electrostatic inverting tube in which the image is inverted by an electron lens (FIG. 1). These tubes are often 25 mm format tubes constructed from the juxtaposition of conductive elements and dielectric elements. Prior art electro-static inverting tubes suffer numerous disadvantages because of their large size and weight, in addition to having numerous parts. In addition, these tubes suffer from distortion in the electron optics and, due to the electron optics, cannot use a Gen III photocathode. This problem is derived from the nature of the electron lens which requires a curved cathode plane. Gen III cathodes as a general rule must be flat. The large size results from the long length required to perform the electro-static image inversion. Moreover, these tubes were designed to have a fiber-optic input window which both increases the cost and weight of the device.

The second general type of prior art tube is a proximity focused tube (generally 25 mm) having a fiber-optic extender bonded to the tube as a partial solution to some of the electro-static inverter deficiencies (FIG. 2). The proximity focused tube is shorter than the electro-static inverter tube because the focusing of the electrons is accomplished by placing the imaging components close to one other. By doing so, however, the image is not inverted. Image inversion, which is required by most goggle systems, is usually accomplished by a fiber-optic inverter which is then bonded onto the tube. Present products have achieved only a minimal weight savings due to package requirements for retrofitting existing devices. While shorter lengths could be realized by making the fiber-optic inverter shorter, design problems including large tube diameters, with respect to the active diameter, and a large input fiber-optic faceplate as the electrostatic inverter tube still exists.

The third prior art tube comprises a tube (generally 18 mm) with the inverter inside the vacuum envelope or housing (FIG. 3). This tube replaces the fiber-optic faceplate with a glass faceplate, thereby providing higher resolution at lower cost, and makes the fiber-optic inverter part of the image tube envelope. While this tube has the smallest packing density of all the prior art tubes, several disadvantages still exist. First, the thickness of the faceplate makes an objective lens design more complex and costly. This was a trade-off in changing from a fiber-optic to glass faceplate. Moreover, this design is susceptible to stray light in the cathode faceplate.

In view of the prior art, there exists a need for an improved image intensifier tube having a housing including the inverter portion and that is both small and lightweight. Furthermore, the improved housing must maintain a reliable vacuum integrity, prevent stray light, and retain the MCP while electrically isolating the photocathode, MCP and anode from one another.

SUMMARY OF THE INVENTION

An improved image intensifier tube has electrically operative components that include a photocathode having a photoemissive layer, a microchannel plate having a conductive input surface and a conductive output surface, and a vacuum housing for retaining the photocathode, microchannel plate and a fiber optic inverter in a predetermined arrangement within an evacuated environment. The fiber optic inverter has a phosphor screen for receiving electrons emitted by the cathode and converts the electrons into a visual image. The improved intensifier includes a ring assembly disposed in the housing comprising first and second rings. The first ring is a metallized snap ring conductively contacting the input surface of the microchannel plate for providing electrical contact to and retaining the plate within the housing. The second ring is a ceramic ring having a first metallized surface in electrical contact with the first ring and has second metallized surface for providing an electrical contact external to the housing. The fiber optic inverter has a circumferentially extending flange portion extending toward the housing to accommodate a sealing material which sealingly engages an inner surface of an output flange with the inverter flange portion to form an air impervious vacuum seal and where the output flange is supported by the fiber optic inverter flange portion.

BRIEF DESCRIPTION OF THE DRAWINGS

The invention is to be explained in more detail below based on embodiments depicted in the following figures where.

DETAILED DESCRIPTION OF THE INVENTION

Figure 3:
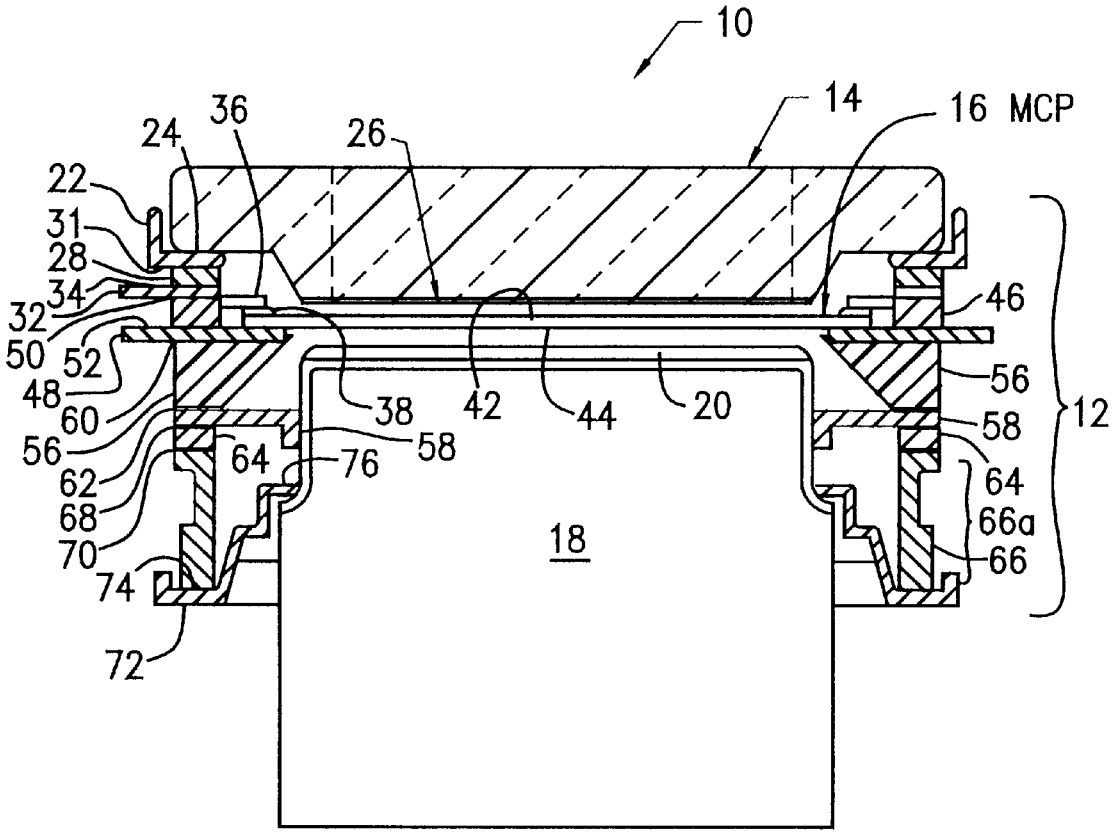
(PRIOR ART) FIG. 3
FIG. 3 is a cross sectional view of a prior art image intensifier with a fiber optic inverter element within the vacuum housing.

Referring to FIG. 3, there is shown a cross-sectional view of a conventional prior art Gen III image intensifier tube 10 of the type currently manufactured by ITT Night Vision of Roanoke, Va. The prior art Gen III image intensifier tube 10 includes an evacuated housing 12 made from the assemblage of several separate components. Within the housing 12 is positioned a photocathode 14, microchannel plate (MCP) 16, and an inverting fiber optic element 18, which supports a phosphor screen 20. The construction for the vacuum housing 12 usually includes at least eighteen separate elements stacked atop one another and joined so as to form an air tight envelope between the photocathode 14 and the fiber optic element 18.

The photocathode 14 rests upon a conductive support ring 22 at one end of the vacuum housing 12. The abutment of the photocathode 14 against the support ring 22 creates an air tight seal thereby closing one end of the vacuum housing 12. The support ring 22 contacts a metalized surface 24 on the face of the photocathode 14. The metalized surface 24, in turn, is coupled to a photoresponsive layer 26, on the photocathode 14 that is contained within the evacuated environment of the vacuum housing 12. As such, an electrical bias can be applied to the photoresponsive layer 26 of the photocathode 14 within the evacuated environment by applying an electrical bias to the support ring 22 on the exterior of the vacuum housing 12.

A first annular ceramic spacer 28 is positioned below the support ring 22. The first ceramic spacer 28 is joined to the support ring 22 by a first copper brazing ring 30 which is joined to both the first ceramic spacer 28 and the support ring 22 during a brazing operation. The brazing operation thereby creates an air impervious seal between the support ring 22 and first ceramic spacer 28. An upper MCP terminal 32 is joined to the first ceramic spacer 28, opposite support ring 22. The upper MCP terminal 32 is also joined to the first ceramic spacer 28 in a brazing operation, as such, a second brazing ring 34 is interposed between the upper MCP terminal 32 and the first ceramic spacer 28. The upper MCP terminal 32 extends into the vacuum housing 12 where it conductively engages a metal hold down ring 36 and a contact ring 38. The contact ring 38 engages the conductive upper surface 42 of the MCP 16 while the hold down ring retains it within the housing. Consequently, an electrical bias can be applied to upper surface 42 of the MCP 16 by applying the electrical bias to the upper MCP terminal 32 on the exterior of the vacuum housing 12.

A second ceramic spacer 46 is positioned below the upper MCP terminal 32, isolating the upper MCP terminal 32 from a lower MCP terminal 48. The second ceramic spacer 46 is brazed to both the upper MCP terminal 32 and the lower MCP terminal 48, as such a second brazing ring 50 is interposed between the upper MCP terminal 32 and second ceramic spacer 46 and a third brazing ring 52 is interposed between the second ceramic spacer 46 and the lower MCP terminal 48. The lower MCP terminal 48 extends into the vacuum housing 12 and engages the lower conductive surface 44 of the MCP 16. As such, the lower conductive surface 44 of the MCP 16 can be coupled to ground by connecting the lower MCP terminal 48 to a ground potential external of the vacuum housing 12.

A third ceramic spacer 56 separates the lower MCP terminal 48 from a getter shield 58. The third ceramic spacer is brazed to both the lower MCP terminal 48 and the getter shield 58. As such, a fifth brazing ring 60 is interposed between the lower MCP terminal 45 and the third ceramic spacer 56. Similarly, a sixth brazing ring 62 is interposed between the third ceramic spacer 56 and the getter shield 58.

A fourth ceramic spacer 64 is positioned below the getter shield 58, separating the getter shield from the output screen support 66. The fourth ceramic spacer is brazed to both the getter shield 58 and the output screen support 66. As such, seventh and eighth brazing rings 68 and 70 are positioned above and below the fourth ceramic spacer 64, respectively.

The lower end of the vacuum housing 12 is sealed by the presence of an output screen flange 72. The output screen flange 72 is joined to both the output screen support 66 and the fiber optic element 18. A first seal 74 occurs at the point where the output flange 72 is joined to screen support 66. A second first seal 76 occurs at the location where flange 72 joins the fiber optic element 18. The combination of the three seals (74, 76, and 22) thus forms an air tight envelope defined by the vacuum housing 12 in between the photocathode 14 and the fiber optic element 18, whereby the vacuum housing 12 is constructed by numerous stacked components joined together in an air impervious manner.

Figure 1:
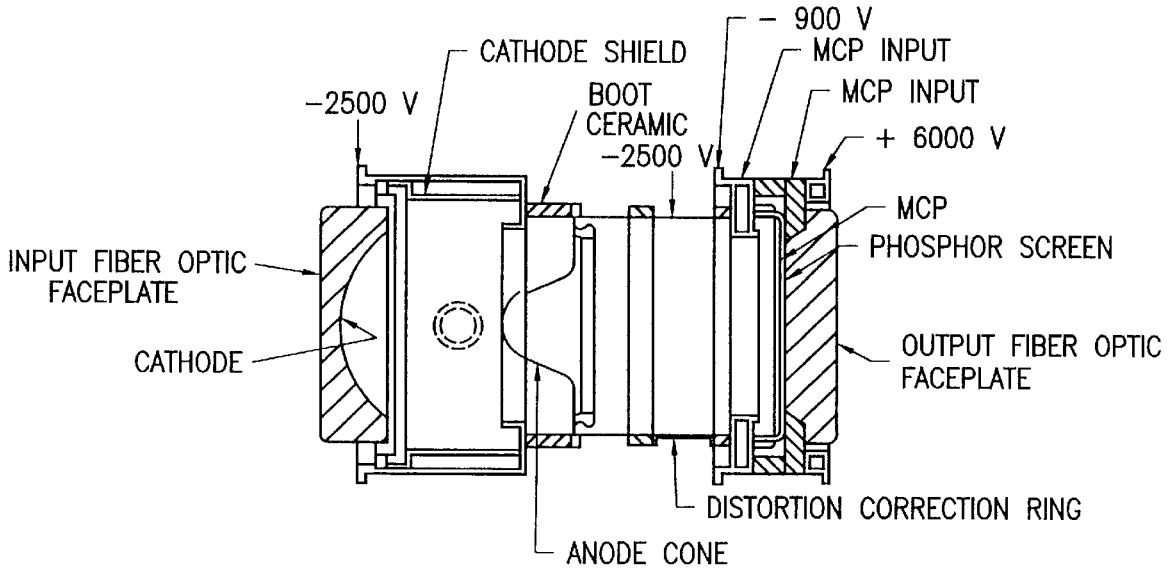
(PRIOR ART) FIG. 1
FIG. 1 is a cross sectional view of a prior art electrostatic inverting tube.
Figure 2:
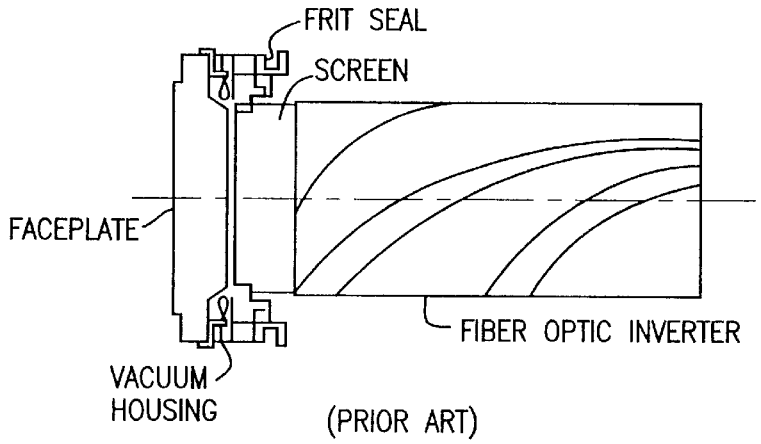
(PRIOR ART) FIG. 2
FIG. 2 is a cross sectional view of a prior art proximity focus tube with a fiber optic extender.

In the prior art embodiment of FIG. 1, the photocathode support ring 22 and upper MCP terminal 32 are separated by the first ceramic spacer 28. The first ceramic spacer 28 is not large. As such, if large differences in potential are applied to the support ring 22 and the upper MCP terminal 32, arcing or other electrical leakage may occur across the first ceramic spacer 28 on the exterior of the vacuum housing 12. Similarly, if large varied potentials are applied between the upper MCP terminal 32 and lower MCP terminal 48, similar arcing or other leakage may occur across the second ceramic spacer 46. Such leakage problems are particularly prevalent across the exterior of the vacuum housing 12 in humid environments. The prior art uses two seals in the housing design (reference numerals 74 and 76). Because of the multiple seals the unit is susceptible to vacuum leakages at either one or both of the seals. In addition, the length of the vacuum housing is extended as evidenced by the length 66A of screen support 66 required to seal both the output flange 72 and ceramic spacer 64 as well as maintain the tube in its fixture.

Figure 4:
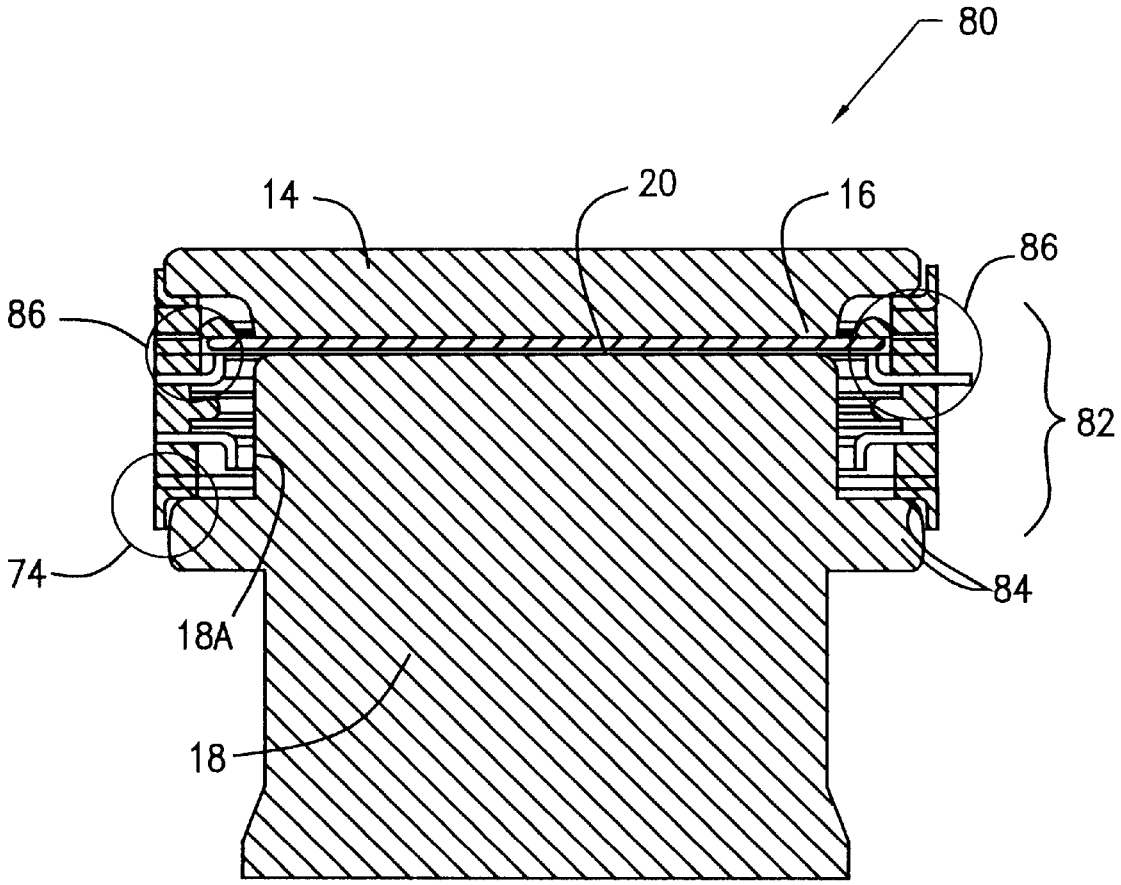
FIG. 4 is a cross sectional view of one preferred embodiment of the present invention image intensifier tube.
Figure 5:
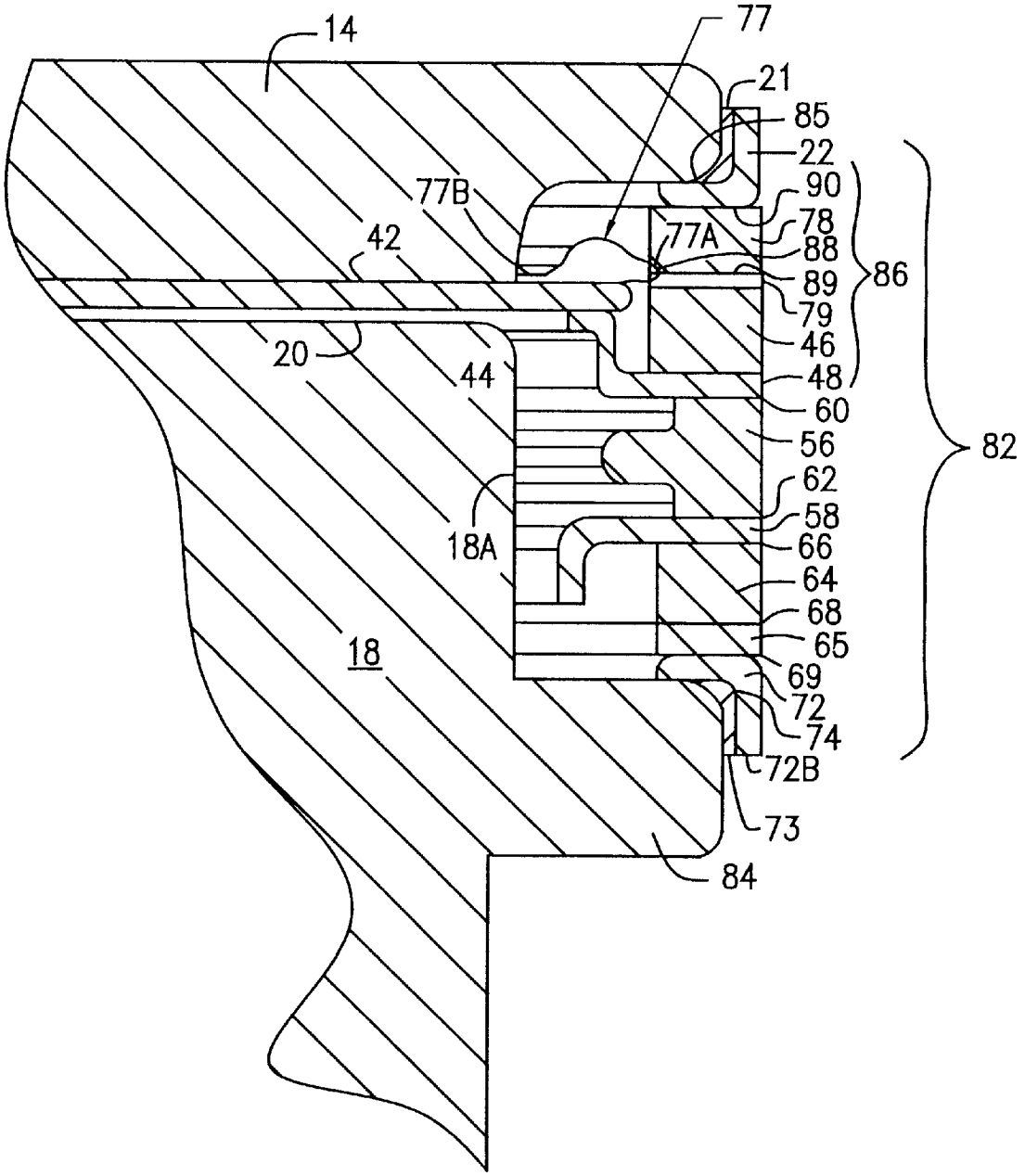
FIG. 5 is an enlarged, detailed view of the embodiment of FIG. 4.

Referring now to FIGS. 4 and 5, there is shown an image intensifier tube 80 embodying one preferred embodiment of the present invention vacuum housing 82. The vacuum housing 82 is formed to retain a photocathode 14, a microchannel plate 16 and a phosphor screen 20 deposited on a fiber optic inverter element 18. The inverter element 18 has a circumferentially extending flange portion 84 defining the lower end of the vacuum housing. The snap ring assembly 86 retains the MCP within the housing, providing support thereto and preventing any axial or lateral displacement.

FIG. 5 represents an exploded view of the image intensifier tube shown in FIG. 4. Referring to FIG. 5, reference numeral 14 comprises a thin glass photocathode having a thickness of approximately 0.155 inches, and a tube diameter of approximately 25 mm. The photocathode faceplate 14 thickness has been significantly reduced in the present invention from a typical dimension of 0.215" to 0.155" by moving the entire MCP support mechanism forward within the tube (i.e. reducing the length defining the vacuum housing 82) and using a unique snap ring assembly to retain the MCP, as will be described. The use of a thin glass faceplate 14 allows a system optical designer to make a lighter objective lens (not shown) since a thinner faceplate adds less aberration than a thicker faceplate. Furthermore, it is easier to correct aberrations by having the last powered surface of the objective lens closer to the image plane. Also, the thinner faceplate permits the objective lens to be moved closer to a user's head for head-mounted applications such as night vision goggles. Thus, the center of gravity of the goggle moves closer to the user's normal center of gravity.

Figure 6:
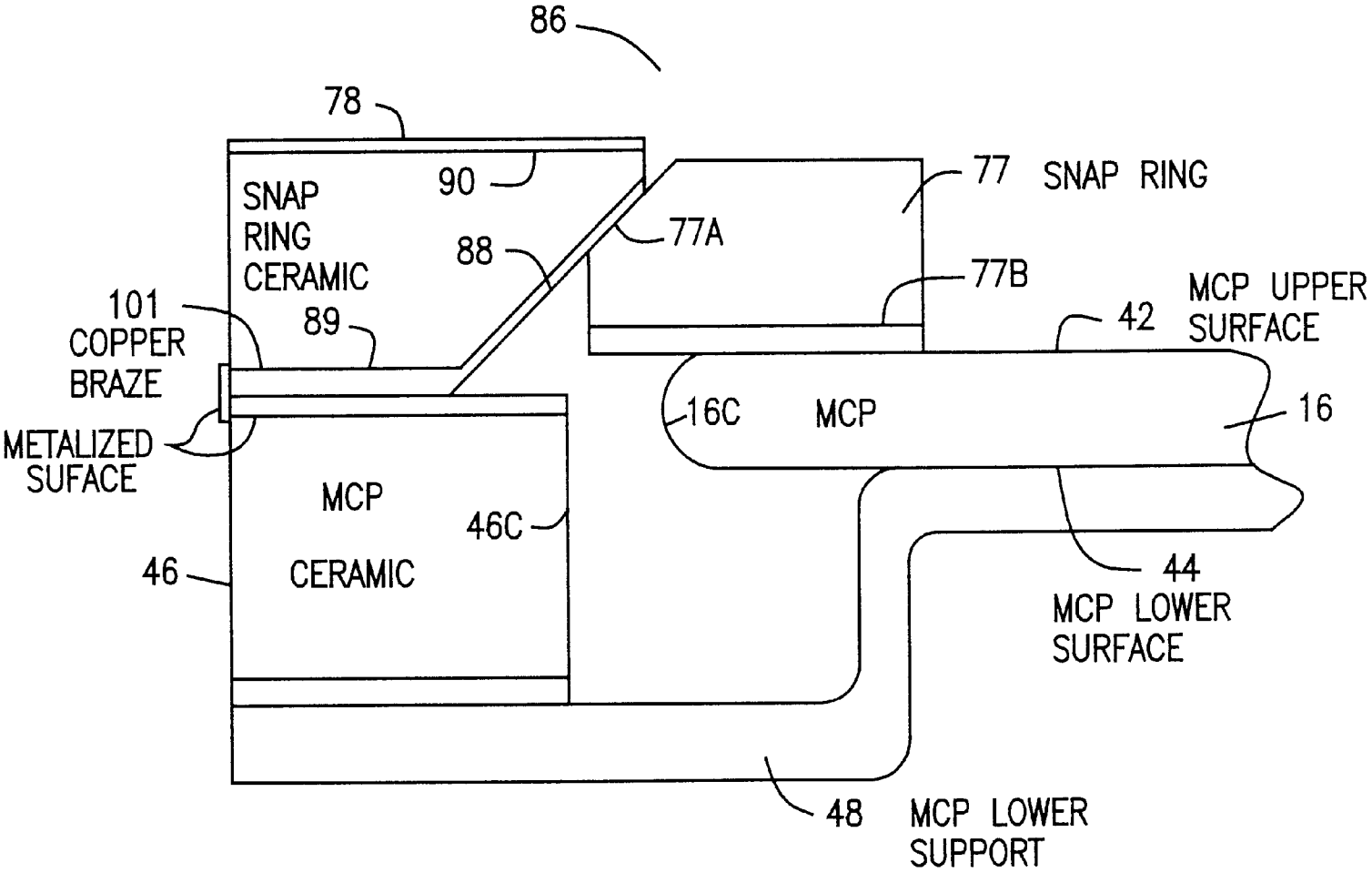
FIG. 6 is a detailed view of the ring assembly of FIG. 5.

In referring to FIGS. 4 and 5, like reference numerals are used to describe similar elements shown in FIG. 1. FIG. 5 shows a support ring 22 positioned below the ledge 85 of photocathode 14, as in the prior art. The recess formed between support ring 22 and photocathode ledge 85 is filled with a sealing material 21. In the preferred embodiment, the sealing material is indium. A ceramic ring 78 is positioned below support ring 22 and joined to the ring during a brazing operation. The brazing operation creates an impervious seal between the support ring 22 and the ceramic ring 78. The ceramic ring 78 is part of the ring assembly 86 shown in detail in FIG. 6 for retaining the MCP. The ring assembly 86 includes the metalized ceramic ring 78, conductive snap ring 77, MCP ceramic ring 46, and MCP lower support terminal 48. The ceramic ring 78 includes a first metalized surface 88 in electrical contact with conductive snap ring 77, and a second metallized surface 89 for providing electrical contact external to the housing to permit a potential source to be applied. In the preferred embodiment, ceramic ring 78 is in contact with metal support flange 22 at an upper surface 90 and with metal contact ring 79 at surface 89. The conductive snap ring 77 is formed of a metal or metallic alloy. In the preferred embodiment, snap ring 77 has a surface 77B conductively engaging the upper surface 42 of the MCP and another surface 77A interbonded to surface 88 of ceramic ring 78. As illustrated in FIGS. 4, 5, and 6, the conductive snap ring 77 is positioned between the photocathode 14 and the snap ring ceramic 78, with the microchannel plate surface 42 resting against and retained by the snap ring 77 and ceramic ring 78 combination. MCP insulator ceramic ring 46 is positioned below and coupled to contact ring 79 by a brazing ring (not shown) interposed between the two elements. The MCP insulator ceramic ring 46 is brazed to both the contact ring 79 and the MCP lower support 48. Alternatively, the contact ring may be removed and the MCP insulator ceramic ring 46 and metalized ceramic ring 78 joined by a copper braze 101 as shown in FIG. 6. In either case, the MCP lower support 48 extends into the vacuum housing and conductively engages the lower conductive surface 44 of the MCP 16. As such, the lower conductive surface can be coupled to ground by connecting the lower MCP support 48 to a ground potential external to the vacuum housing 12. As shown in FIG. 5, ceramic spacer 56 separates the lower MCP support 48 from a getter shield 58. This ceramic spacer is brazed to both the lower MCP support and the getter shield via two additional brazing rings 60 and 62. Ceramic spacer 64 is positioned below getter shield 58, separating the getter shield from the getter tab 65. Brazing rings 66 and 68 are positioned above and below ceramic spacer 64, respectively.

The lower end of vacuum housing 12 is sealed by metal output screen flange 72. Output screen flange 72 is joined to getter tab 65 via brazing ring 69 and to fiber optic element 18 via an indium sealing material 73. Fiber optic element 18 comprises a first portion 18A of uniform circumference and a second circumferentially extending flange portion 84 extending toward the housing and engaging inner surface 72B of output flange 72. The output flange 72 thus rests against and is supported by circumferentially extending portion 84. An indium compound 73 joins the output flange 72 with inverter 18 to seal 74 the vacuum housing constructed by each of the stacked components in an air impervious manner.

Figure 9:
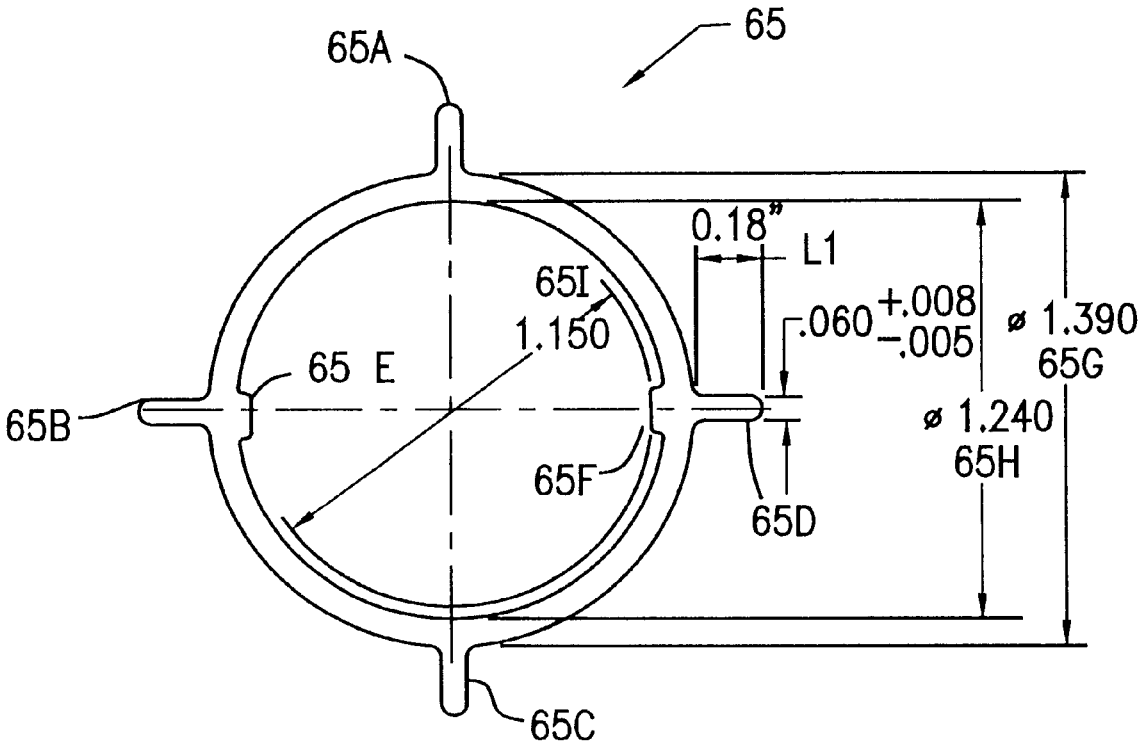
FIG. 9 is a detailed view of the getter tab ring found in FIG. 5.

As can be seen from FIGS. 5 and 6, the present invention includes the fiber optic inverter element 18 built into the image tube housing. However, unlike prior art tube designs, the present invention includes only a single fiber optic-to-tube seal 74 instead of the normal metal frit-optic tube seal 76 shown in FIG. 3 (Prior Art). The present invention thus eliminates one seal, thereby increasing the robustness of the tube against vacuum leaks. Moreover, the sealing arrangement of the present invention eliminates the elongated portion 66 or dagger part of seal 74 shown in FIG. 3 (Prior Art), thereby permitting the tube length to be shortened by approximately 0.2 inches. In the present invention, getter tab 65 shown in FIG. 5 is operable to hold the tube in its fixture by means of a series of tabs extending radially from the getter tab ring 65. FIG. 9 shows an expanded view of the preferred embodiment of the getter tab 65. As shown in FIG. 9, getter tab ring 65 comprises an annular ring having four tabs 65A–D extending radially from the perimeter at 90° intervals, each tab of a length of L1=0.18" from the perimeter to contact the housing to maintain the tube within the housing. In the preferred embodiment, getter tab ring support 65 has an outer diameter 65G of 1.390" and an inner diameter 65H of 1.240". Getter tab ring 65 also has inwardly extending segments 65E–F to support the getters (not shown), wherein the most inner diameter 65I measured between two oppositely located inward segments is 1.150". The relative dimensions of the getter tab ring in the preferred embodiment of the invention is as shown in FIG. 9.

Figure 8C:
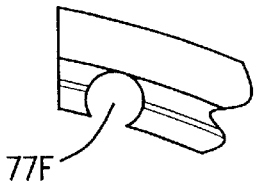
FIGS. 8A–C are detailed views of the conductive snap ring found in FIG. 5.
Figure 8A:
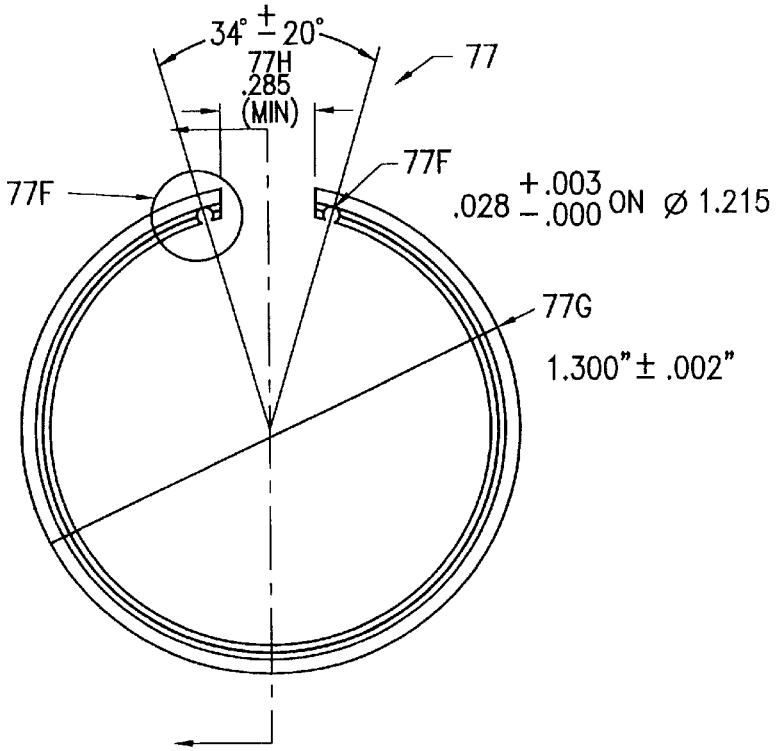
Figure 8B:
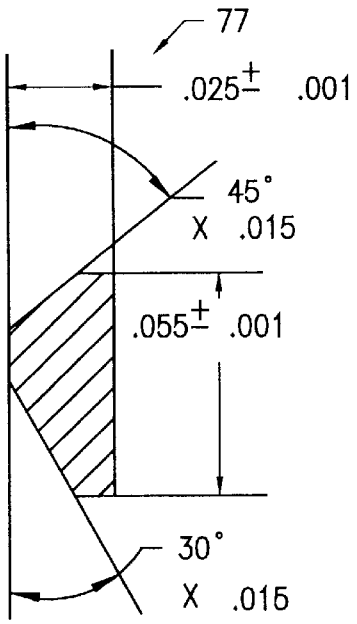

The conductive snap ring 77 is made of a special material which does not anneal during post lockdown (i.e. high heating manufacturing) processing so as to properly retain the MCP. As part of the manufacturing process, an image intensifier tube is subject to high temperatures (on the order of 360 degrees Fahrenheit or more) to allow brazing and hermetic sealing of the elements to occur. If the snap ring anneals during high temperatures, thereby losing its elasticity, the ring will be unable to properly retain the MCP. In the preferred embodiment, the snap ring is made of a stainless steel metal alloy which, when subject to temperatures in excess of 360 degrees Fahrenheit, does not anneal. This permits the snap ring to retain the MCP. Metal alloys, including beryllium copper or inconel may be used. The snap ring also may optionally be nickel plated. A detailed diagram of the snap ring is shown in FIGS. 8A–C. FIG. 8A shows a top view of the snap ring 77. In the preferred embodiment, the snap ring has an outer diameter 77G of 1.3±0.002 inches and an angular separation 77I of 34 degrees ±20 degrees to insert and lockdown the ring. The minimum separation cavity distance 77H is 0.285". FIG. 8B shows a detailed view of the cross section of the snap ring, with the relevant dimensions of the snap ring as shown. Snap ring 77 also has dual cavities 77F carved out of the ring surface as illustrated in FIG. 8C to permit proper insertion into the housing via a specialized insertion instrument (not shown).

Figure 7A:
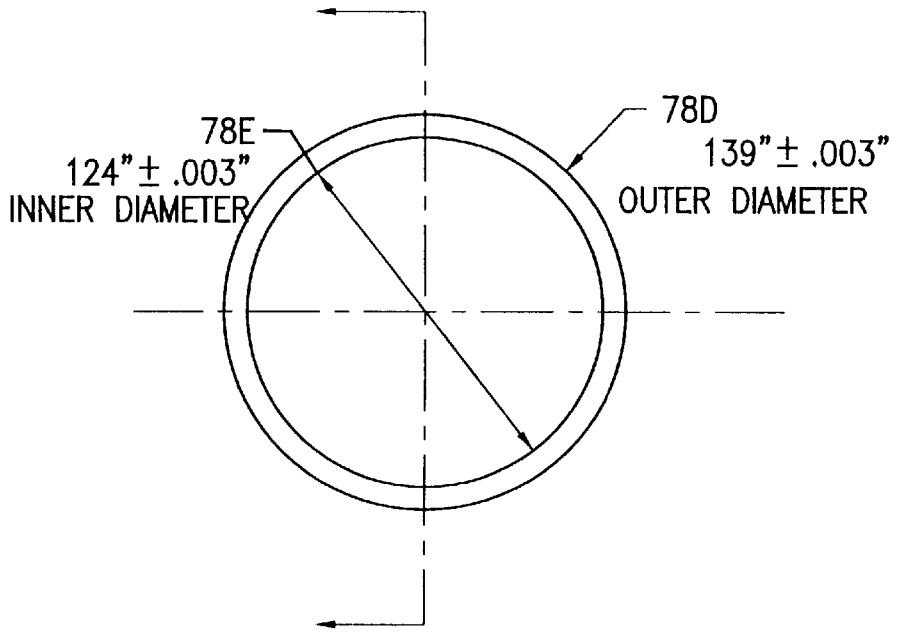
FIGS. 7A and 7B are detailed views of the metalized ceramic ring found in FIG. 5.
Figure 7B:
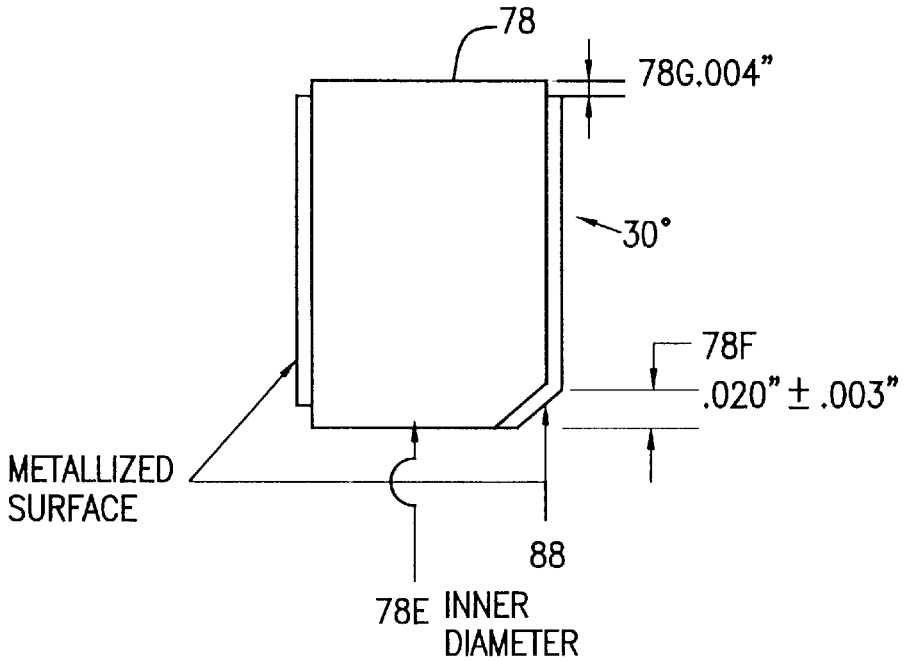

Referring to FIG. 7A, there is shown a top view of the metallized ceramic ring. In the preferred embodiment, the ceramic ring has an outer diameter 78D of 1.390"±0.003" and an inner diameter 78E of 1.240"±0.003". As shown in FIG. 7B, ceramic ring 78 is chamfered on metallized surface 88 at a 30 degree angle to conductively engage metal contact ring. The width of the chamfered edge is approximately 0.020"±0.003". The separation 78G between the end of the metalized surface and the outer diameter is approximately 0.004". Preferably, the metallized surface is 94 percent alumina, although other conductive materials may be used.

Figure 10:
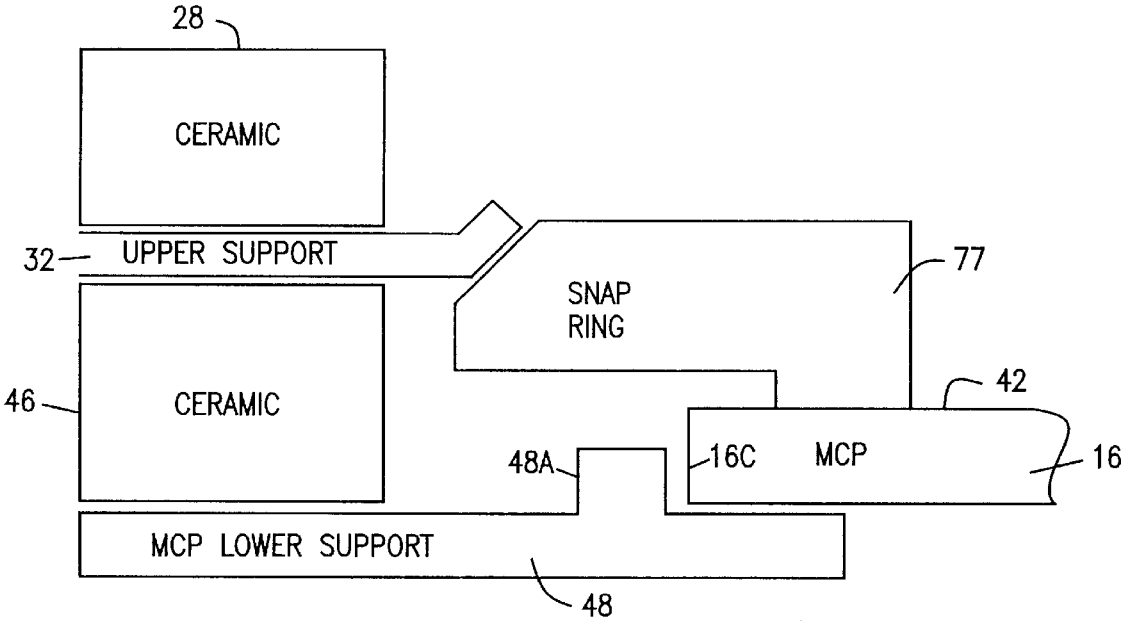
(PRIOR ART) FIG. 10
FIGS. 10 and 11 are detailed views of prior art ring assemblies.
Figure 11:
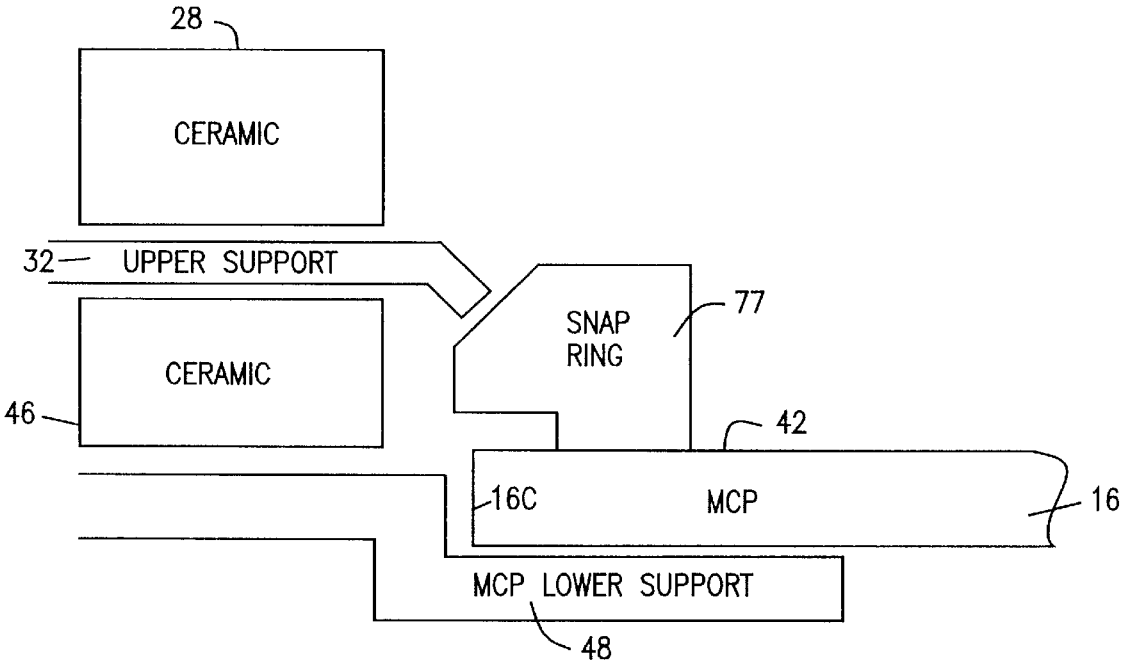
(PRIOR ART) FIG. 11

As can be seen from FIGS. 5 and 6, the snap ring assembly of the present invention advantageously retains the microchannel plate by using the metallized ceramic 78 in combination with the metal snap ring 77 to provide both the lockdown and electrical contact, thereby eliminating the need for complex metal parts including mechanical rings and tabs used in the prior art to hold in place the MCP. Using a metallized ceramic in place of complex metal assemblies thus eliminates a costly part of the snap ring joint assembly. Furthermore, the MCP insulator ceramic 46 serves to center the MCP within the housing to prevent lateral dislocation, while electrically isolating MCP lower support 48, whose flat structural shape is interbonded to both the MCP and the MCP insulator ceramic so as to structurally support the MCP at a location opposite the snap ring. In the prior art shown in FIGS. 10 and 11, the MCP lower support 48 is employed to both laterally center and axially support the MCP 16. Precise manufacturing of the MCP lower support member is thus required to perform these dual functions. As can be seen in FIG. 10 prior art, complicated milling and manufacturing of the lower support structure to provide a tab portion 48A lateral to surface 16C of the MCP to prevent lateral dislocation while at the same time maintaining sufficient distance from snap ring conductive surface 77A to prevent short circuiting the device. The present invention as shown in FIG. 6 eliminates this problem by providing the MCP insulator ceramic ring 46 such that a surface 46C is laterally aligned with MCP surface 16C to prevent lateral dislocation, while the MCP lower support structure 48 is positioned entirely below the MCP 16 and in contact with the MCP only at the MCP lower surface contact layer 44 to provide axial support and terminal contact.

The advantages of the present invention are manifold. First, as previously indicated, the thin faceplate allows the system optical designer to make a lighter objective lens as less aberration exists in the thinner faceplate, requiring less correction and permitting the powered surfaces of the objective lens to be closer to the image plane. Also, the thinner faceplate permits the objective lens to be moved closer to the user's head for head-mounted applications, thereby moving the device center of gravity closer to the user's normal center of gravity. Furthermore, use of the metal snap ring in combination with the metallized ceramic ring to retain the MCP allows the active tube diameter to be larger for a given physical diameter. This is also called fill factor. The fill factor for a standard 18 mm and 25 mm diameter tube is 30%. That is the amount of active area to physical area is 30%. The proposed design has demonstrated a 50% fill factor. As a comparison, the normal 25 mm diameter is 1.75" while the demonstrated tube is 1.39" and an 18 mm tube is 1.231" and could be made as small as 1.18" or less using these concepts. Moreover, the thinner faceplate and better fill factor also allow a smaller package tube. As an example, a 25 mm inverting tube as described in the present invention would weigh approximately 85 grams with a wrap around power supply like the standard (prior art) 18 mm inverting tube. This weight is equivalent to the weight of the standard 18 mm non-inverting tube.

While there has been shown preferred embodiments of the present invention, those skilled in the art will further appreciate that the present invention may be embodied in other specific forms without departing from the spirit or central attributes thereof. More specifically, it should be understood that while a 25 mm inverting tube has been shown, the concept and central attributes embodying the invention could be used on any format tube, including non-Gen III image intensifier tubes. All such variations and modifications are intended to be within the scope of this invention as defined by the appended claims.

What is claimed is:

1. In an image intensifier tube having electrically operative components that include a photocathode having a photoemissive layer, and a microchannel plate (MCP) having a conductive input surface and a conductive output surface, retained within an evacuated environment of a vacuum housing, an improved vacuum housing comprising:

a ring assembly disposed in said housing comprising first and second rings, said first ring being a metallized snap ring conductively contacting said input surface of said microchannel plate for providing electrical contact to and retaining said plate within said housing, said second ring being a metallized ceramic ring having a first metallized surface in electrical contact with said metallized snap ring and a second metallized surface operable to provide an electrical contact external to said housing.

2. The image intensifier tube of claim 1, wherein said snap ring is made of a non-annealing material operable to withstand temperatures exceeding 360 degrees Fahrenheit.

3. The image intensifier tube of claim 1, wherein said photocathode is glass having a thickness less than 0.2 inches.

4. The image intensifier tube of claim 1, wherein said snap ring is nickel-plated.

5. The image intensifier of claim 1, further including:

an output window comprising a first portion which includes a phosphor screen for receiving said electrons emitted by said cathode and converting said electrons emitted by said cathode into a visual image, and a second circumferentially extending portion unitarily formed with said first portion; and a flange disposed on said second circumferentially extending portion having a lower surface in sealed engagement therewith and an upper surface opposite said lower surface defining an end of said vacuum housing.

6. The image intensifier of claim 5, wherein said output window is a fiber optic inverter.

7. The image intensifier tube of claim 5, wherein said flange is sealed to said second circumferentially extending portion via a sealing material comprising indium.

8. The image intensifier of claim 1, wherein said ring assembly further comprises:

a microchannel plate (MCP) ceramic ring having a first surface coupled to said metallized ceramic ring and a second surface opposite said first surface, said MCP ceramic ring positioned lateral to said MCP and operable for preventing lateral displacement of said MCP; and an MCP support terminal having a first surface extending from a minimum to a maximum position and coupled to said second surface of said MCP ceramic ring at a first portion thereof defining said minimum position, and conductively engaging said MCP along a bottom surface of said MCP at a second portion thereof defining said maximum position.

9. The image intensifier of claim 1, wherein said first metalized surface associated with said ceramic ring includes a chamfered edge portion for contacting said metalized snap ring.

10. In an image intensifier tube having electrically operative components that include a photocathode having a photoemissive layer, and a microchannel plate having a conductive input surface and a conductive output surface, an improved vacuum housing for retaining said photocathode, said microchannel plate and an output window in a predetermined arrangement within an evacuated environment, said output window having a first portion including a phosphor screen for receiving said electrons emitted by said cathode and converting said electrons into a visual image, said improvement therewith comprising:

said output window having a circumferentially extending flange portion unilaterally formed with said first portion, said flange portion supportive of and in sealed engagement with an inner surface of an output flange of said housing by means of a sealing material, wherein an air impervious vacuum is formed at said seal within said housing.

11. The image intensifier tube of claim 10, further including a ring assembly disposed in said housing comprising first and second rings, said first ring being a metallized snap ring conductively contacting said input surface of said microchannel plate for providing electrical contact to and retaining said plate within said housing, said second ring being a metallized ceramic ring having a first metallized surface in electrical contact with said metallized snap ring and a second metallized surface operable to provide electrical contact external to said housing.

12. The image intensifier tube of claim 11, wherein said ring assembly further includes a microchannel plate (MCP) ceramic ring having first and second oppositely disposed surfaces and coupled to said metalized ceramic ring at said first surface and to an MCP support ring at said second surface, said MCP ceramic ring located lateral to said MCP and operable to prevent lateral displacement of said MCP, said MCP support ring positioned lower than the bottom surface of said MCP along the entire length of said support ring and conductively engaging said MCP at a position on the bottom surface of said MCP to provide axial structural support to said MCP.

13. The image intensifier tube of claim 10, further including a getter tab ring coupled to an outer surface of said output flange at the lower portion of said housing, said getter tab ring having a plurality of radially extending tabs in contact with the surface of said housing to fixedly support said image intensifier tube within said housing.

14. The image intensifier tube of claim 10, wherein said photocathode is glass having a thickness of substantially 0.155 inches.

15. The image intensifier tube of claim 10, wherein said snap ring is made of a non-annealing material operable to withstand temperatures exceeding 360 degrees Fahrenheit.

16. The image intensifier tube of claim 15, wherein said metalized ceramic comprises alumina.

17. An improved image intensifier tube having electrically operative components that include a photocathode having a photoemissive layer, a microchannel plate having a conductive input surface and a conductive output surface, and a vacuum housing for retaining said photocathode, said microchannel plate and a fiber optic inverter in a predetermined arrangement within an evacuated environment, said fiber optic inverter having a phosphor screen for receiving said electrons emitted by said cathode and converting said electrons into a visual image, the improvement therewith comprising:

a ring assembly disposed in said housing comprising first and second rings, said first ring being a metallized snap ring conductively contacting said input surface of said microchannel plate for providing electrical contact to and retaining said plate within said housing, said second ring being a metallized ceramic ring having a first chamfered metallized surface in electrical contact with said metallized snap ring and a second metallized surface operable to provide an electrical contact external to said housing; and said fiber optic inverter having a unitarily formed and circumferentially extending flange portion extending toward said housing, wherein a sealing material sealingly engages an inner surface of an output flange with said inverter flange portion to form an air impervious vacuum seal, said output flange supported by said inverter flange portion.

18. The image intensifier tube of claim 17, wherein said ring assembly further includes a microchannel plate (MCP) ceramic ring coupled to said metalized ceramic ring at a first surface and to an MCP support ring at a second surface opposite said first surface, said MCP ceramic ring located lateral to said MCP and operable to prevent lateral displacement of said MCP, said MCP support ring positioned below said MCP over the entire length of said supporting ring and conductively engaging said MCP at a point on a lower conductive surface of said MCP to provide axial structural support to said MCP.

19. The image intensifier tube of claim 17, further including a getter tab ring coupled to an outer surface of said output flange at the lower portion of said housing, said getter tab ring having a plurality of radially extending tabs in contact with the surface of said housing to fixedly support said image intensifier tube within said housing.

20. The image intensifier tube of claim 17, wherein said plurality of radially extending tabs is four.

21. The image intensifier tube of claim 17, wherein said photocathode is glass having a thickness of substantially 0.155 inches.

22. The image intensifier tube of claim 17, wherein said metalized ceramic ring comprises alumina.

* * * * *